US008317548B2

(12) United States Patent
Sagdic et al.

(10) Patent No.: US 8,317,548 B2
(45) Date of Patent: Nov. 27, 2012

(54) ELECTRICAL CONNECTOR

(75) Inventors: Mehmet Sagdic, Detmold (DE); Stefan Giefers, Detmold (DE)

(73) Assignee: Phoenix Contact GmbH & Co. KG (DE)

( * ) Notice: Subject to any disclaimer, the term of this patent is extended or adjusted under 35 U.S.C. 154(b) by 0 days.

(21) Appl. No.: 12/787,501

(22) Filed: May 26, 2010

(65) Prior Publication Data

US 2011/0294335 A1 Dec. 1, 2011

(51) Int. Cl.
*H01R 4/24* (2006.01)

(52) U.S. Cl. ..... 439/729; 439/441

(58) Field of Classification Search ..... 439/441, 439/728–729, 750, 268, 835
See application file for complete search history.

(56) References Cited

U.S. PATENT DOCUMENTS

| | | | | |
|---|---|---|---|---|
| 4,768,981 | A * | 9/1988 | Hohorst | 439/835 |
| 5,529,522 | A * | 6/1996 | Huang | 439/460 |
| 6,719,581 | B2 * | 4/2004 | Kikuchi | 439/441 |
| 7,104,833 | B2 * | 9/2006 | Oesterhaus | 439/441 |
| 7,238,043 | B2 * | 7/2007 | Reibke et al. | 439/441 |
| 7,306,477 | B1 * | 12/2007 | Huang et al. | 439/441 |
| 7,568,943 | B2 * | 8/2009 | Harrison et al. | 439/578 |
| 2004/0171291 | A1 * | 9/2004 | Lefki et al. | 439/242 |

* cited by examiner

*Primary Examiner* — Renee Luebke
*Assistant Examiner* — Larisa Tsukerman
(74) *Attorney, Agent, or Firm* — Kaplan Breyer Schwarz & Ottesen, LLP

(57) ABSTRACT

The present invention relates to an electrical connector with a first and a second sub-assembly. The first sub-assembly comprises a contact area for receiving a conductor end and for establishing an electrical contact with the received conductor end. The first sub-assembly further comprises a clamping device for clamping the conductor in the contact area. The second sub-assembly comprises a hollow body with a hollow space for receiving the contact area. The first and the second sub-assemblies are made as one piece and are configured to release the clamping device in the open state for manually clamping the conductor end, and to electrically insulate the contact area including the clamping device in the closed state.

12 Claims, 6 Drawing Sheets

ELECTRICAL CONNECTOR

FIELD OF THE INVENTION

The invention relates to an electrical connector. The connector comprises a contact area for receiving a conductor end. The contact area serves for establishing an electrical contact with the received conductor end. A clamping device for clamping the conductor end is provided in the contact area.

BACKGROUND OF THE INVENTION

Single-pole waterproof connectors, in particular for applications in the photovoltaics industry, are typically provided with an electric cable by crimping the cable to a contact element. Crimping requires a special tool for fabricating the crimp connection. Furthermore, once a crimp connection is fabricated, it is no longer detachable.

From DE 196 13 557, a clamp with a flexible spring is known. Here, the flexible spring is shaped in a relatively complex manner and, in any case, a relatively high force must be applied to close the clamp. On the other side, the load arm is relatively long and the clamp is relatively large and difficult to handle. A further disadvantage is that the conductor end can only be inserted with the contact clamp being open. Moreover, in case of a tensile load, a force component acting on the load arm in the direction of the opening is generated, whereby a high pre-load is required or the contact reliability may be affected. Also, the clamp is prepared for plugging onto a bus bar and is not suited for single contacting.

Usually, electrical connectors are composed of separate individual components. After applying and fastening a cable end in one of the components, the individual parts must be connected to one another to form a unit which electrically insulates the conductor from the outside and protects from moisture.

SUMMARY OF THE INVENTION

It is thus an object of the invention to simplify connecting electrical cables, e.g. to connectors, and to allow a manual connecting, in particular without special tools.

The present invention relates to an electrical connector with a first and a second sub-assembly. The first sub-assembly comprises a contact area for receiving a conductor end and for establishing an electrical contact with the received conductor end. The first sub-assembly comprises further a clamping device for clamping the conductor end within the contact area. The second sub-assembly comprises a hollow body with a hollow space for receiving the contact area. The first and the second sub-assemblies are formed to release the clamping device in the open state for manually clamping the conductor end, and to electrically insulate the contact area including the clamping device in the closed state.

It is an advantage of the connector according to the invention that it is formed as one piece. However, this does not mean that the sub-assemblies have to be manufactured from a single part, for example from a single molded part. In fact, the two sub-assemblies, which can be composed of separately formed molded parts, are fastened to one another also in the open state so that the sub-assemblies of the connector are connected. Thus, the sub-assemblies are always available. At the same time, the two sub-assemblies are configured in such a manner that the connector can be put into two different states. An open state releases the clamping device. In this state, the conductor end can be inserted and fastened in the connector. The closed state allows to electrically insulate the contact area and to protect the same against moisture or dirt. A single unitary object with two defined states simplifies the use of the connector for the user.

Preferably, the contact area including the clamping device is configured such that it can be moved into the hollow space of the hollow body. When transferring the connector into the closed state, the hollow body forms a mechanical protection against moisture and dirt. At the same time, the hollow body can provide for the electrical insulation of the contact area with respect to the environment. Preferably, the hollow body is configured to enclose the contact area including clamping device in the closed state in a watertight manner. Moisture is particularly critical because it can result in a short or in corrosion of the conductor. For this, in particular, a crimping cap can be provided which compresses an elastomeric sealing sleeve in such a manner that the closure is watertight.

According to a preferred embodiment of the present invention, the first sub-assembly comprises a cap nut for closing the contact area with the received conductor end. The hollow body has preferably an external thread for screwing it to the cap nut. The hollow body screwed together with the cap nut insulates the contact area.

Further, a locking device can be provided to detachably lock the first and the second assembly in the open and/or closed state. Locking in the open state has a plurality of advantages. It is, for example, easier to insert the conductor end into a firmly locked structure consisting of first and second sub-assemblies. Also, the access to the clamping device is stable so that the actuation of the same can take place in an undisturbed and fast manner. A detachable locking is also of advantage in the closed state.

Thus, both states, open and closed, are mechanically clearly defined.

According to a preferred embodiment of the present invention, the connector comprises a linear guide for guiding the first and second assembly relative to one another along a linear path. A linear guide is to be understood as a machine element which allows a preferably frictionless translation of movable assemblies and ensures at the same time that the moving direction—of a linear path—is maintained.

Preferably, the linear guide comprises two guiding members which are telescopically movable in one another. The first assembly can comprise the first guiding member and the second assembly can comprises the second guiding member. The guiding member can serve at the same time as contact pin for the connector. For this, for example, the first guiding member of the first assembly is electrically connected with the contact area.

The invention is illustrated hereinafter in more detail by means of a preferred exemplary embodiment and with reference to the figures. Identical features or features corresponding to one another are designated with the same reference numbers.

DETAILED DESCRIPTION

Figure 1:
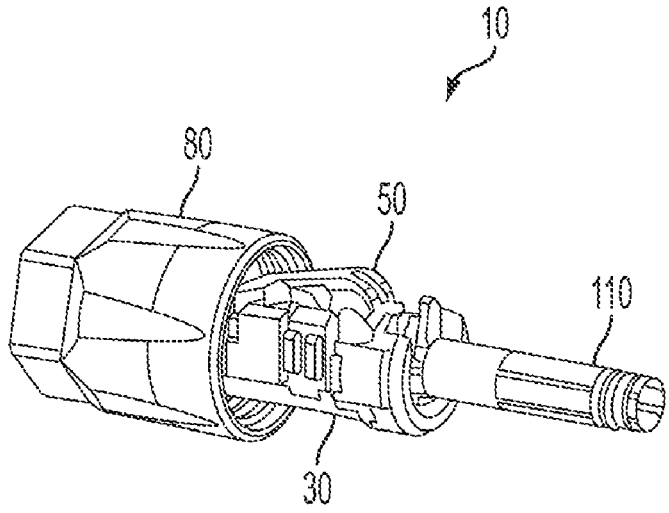
FIG. 1 shows a perspective illustration of a first sub-assembly of the connector according to the exemplary embodiment of the present invention.

The preferred exemplary embodiment of the present invention is described hereinafter with reference to the enclosed figures. FIG. 1 illustrates a first sub-assembly of the electrical connector of the present invention in a perspective view. The sub-assembly 10 comprises the contact area 30 in which a contact to the conductor end is to be established. The conductor end is inserted into the contact area 30 through an opening in a cap nut 80. The insertion direction extends preferably, as in the shown example, along the direction along which the two sub-assemblies 10, 20 are movable relative to one another. The conductor end is clamped to the contact by means of the clamping device 50. The clamping device 50 is configured as spring which can be manually actuated. Finally, a first guiding member of the first assembly is illustrated. This guiding member serves, on the one hand, for mechanically guiding the first assembly 10 relative to the second assembly 20; on the other hand, it conducts the electrical current from the conductor end.

Figure 2:
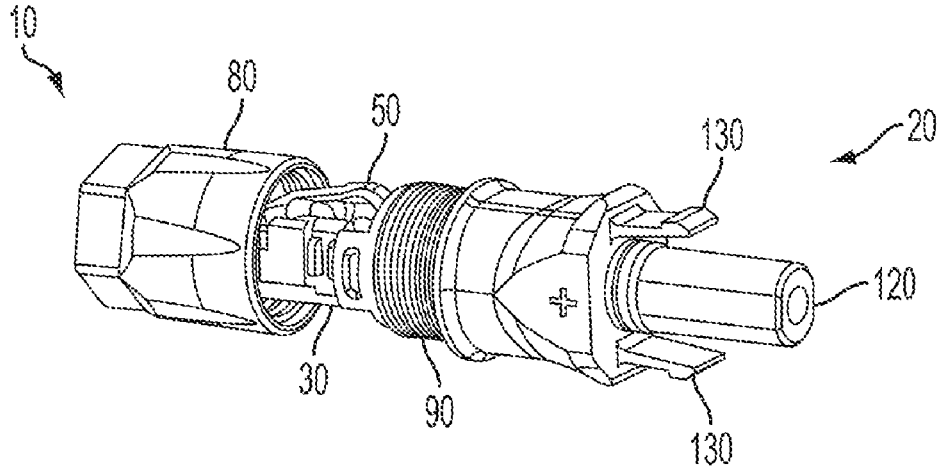
FIG. 2 shows a perspective illustration of the connector according to the exemplary embodiment of the present invention with the first and the second sub-assembly in the open state.

FIG. 2 shows a perspective view of the first and second sub-assemblies of the electrical conductor of the preferred exemplary embodiment. In this illustration, the first and second sub-assemblies 10 and 20 are illustrated in the open state. This is how the electrical connector is typically delivered. First, the user has to guide a conductor end through a (non-shown) opening in a cap nut 80 into the contact area 30. The conductor end is clamped by means of the clamping spring 50 onto the contact area 30. Further, an external thread 90 is provided on the second sub-assembly 20. The first and second sub-assemblies are then inserted into one another and the cap nut 80 is screwed together with the external thread. An advantage of the embodiment is that the sub-assemblies 10 and 20 are formed as one piece. This means, the user has always both necessary assemblies at hand. A potentially difficult insertion of the sub-assemblies into one another is not necessary. The displacement of the sub-assemblies takes place by means of a linear guide (not illustrated in detail) between the two sub-assemblies. Reference number 120 designates again the female part of the connector. This part is at the same time integral part of a linear guide of the electrical connector. Said second guiding member 120 is put over a corresponding part of the counter connector to establish an electrical contact. For mechanical anchorage of the plugged-in electrical connector, two contact springs 130 are provided which each resiliently engage by means of a projection into a corresponding recess of the counter conductor to establish a form-fitting mechanical connection.

Figure 3:
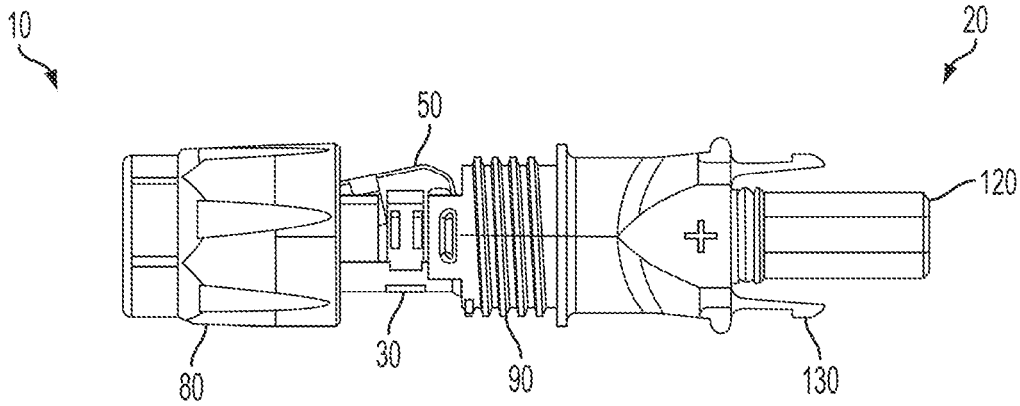
FIG. 3 shows a side view of the electrical connector of the exemplary embodiment of the present invention with the first and the second sub-assembly in the open state.
Figure 4:
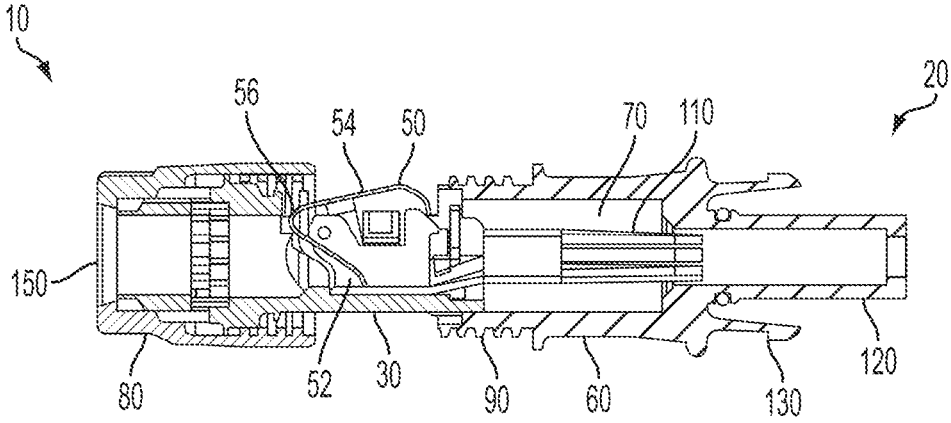
FIG. 4 shows a sectional side view of the preferred exemplary embodiment of the electrical connector in the open state.

FIG. 3 shows a lateral top view of the electrical connector of the preferred exemplary embodiment in the open state. FIG. 4 illustrates a sectional view of the electrical connector. In this illustration, the lateral opening 150 for receiving the conductor end is illustrated for the first time. The conductor end is to be inserted in the conductor up to the contact area. A holding frame is provided with the contact area 30 with which the conductor end can make contact. The clamping device 50 comprises a clamping limb 52 which is pivotably mounted in the holding frame and can be pivoted back and forth between an open and a closed pivot position. In the closed pivot position, the clamping limb 52 clamps the conductor end against the contact area 30 when the conductor end is inserted into the targeted contact position so as to establish the electrical contact between the conductor end and the contact section 30. In the open pivot position, the clamping limb 52 is pivoted away from the contact section 30. In the open pivot position, on the one hand, the conductor end is insertable and, on the other hand, is released for removal. In the closed position, the clamping limb 52 runs angularly toward the contact section and is configured in a resiliently movable manner. Thereby, with the clamping limb 52 elastically bending, the conductor end can be inserted in the closed pivot position into the targeted contact position. To improve the insertion of the conductor end on the one side, and the clamping of the conductor end with respect to a tensile load applied to the conductor on the other, the clamping limb is formed inclined with respect to the insertion direction in such a manner that an acute angle between the conductor and the clamping limb's 52 face contacting the conductor or pointing toward the conductor is formed.

The clamping spring 50 is formed as angle lever. Between an actuating limb 54 and a clamping limb 52, an angled elbow section 56 is arranged. The actuating limb 54, the elbow section 56, and the clamping limb 52 form substantially a V-shape. When the actuating limb 54 is pushed down, the clamping limb 52 is pushed against the conductor end or toward the contact area. The pushed-down clamping limb 52 is lockable so that conductor end and contact area are permanently clamped.

Furthermore, in FIG. 4, a linear guide for guiding the first 10 and second assemblies 20 relative to one another along a linear path is shown. The linear guide comprises two guiding members 110 and 120 which are telescopically movable in one another. The first assembly 10 comprises the first guiding member 110 and the second assembly 20 comprises the second guiding member. The second guiding member comprises a hollow space, the cross-section of which corresponds to the outer cross-section of the first guiding member. Thus, the first guiding member can be pushed into the second guiding member. Pivoting of the first and second guiding members radially to the insertion direction is ruled out by the geometry of the first and second guiding members. The hollow space of the second guiding member as well as the outer shape of the first guiding member is preferably formed cylindrically. The first guiding member 110 of the first assembly 10 is electrically connected with the contact area 30; the second guiding member 120 of the second assembly 20 insulates the first guiding member 110 in the closed state.

Figure 5:
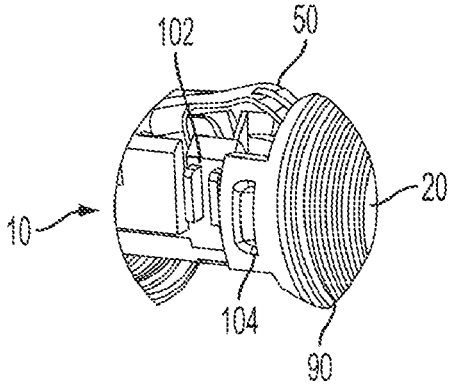
FIG. 5 shows a detailed view of a locking device of the electrical connector according to the preferred exemplary embodiment of the present invention.

FIG. 5 shows an enlarged section of the electrical connector according to the preferred exemplary embodiment. In particular, the transition between the first 10 and second assembly 20 in the open state is illustrated. For this, a locking device 100 consisting of a locking projection 102 and a locking groove 104 is provided. In the locked state, the locking projection 102 engages with the locking groove 104 in such a manner that the sub-assemblies 10 and 20 are no longer movable in one another in longitudinal direction. Preferably, a plurality of locking grooves 104 are provided on the second sub-assembly 20 which are preferably distributed over the circumference of the second sub-assembly 20. Once the locking grooves 104 are engaged with the corresponding locking projections 102, at the same time, a translation of the sub-assemblies along a longitudinal axis 106 and a rotation about the longitudinal axis 106 relative to one another is prevented. As soon as the interlock of the clamping device 100 is released, both sub-assemblies can be moved along the longitudinal axis into one another or apart from one another. However, the connector 5 involves a one-piece component. Both sub-assemblies can not be readily separated from one another.

Figure 6:
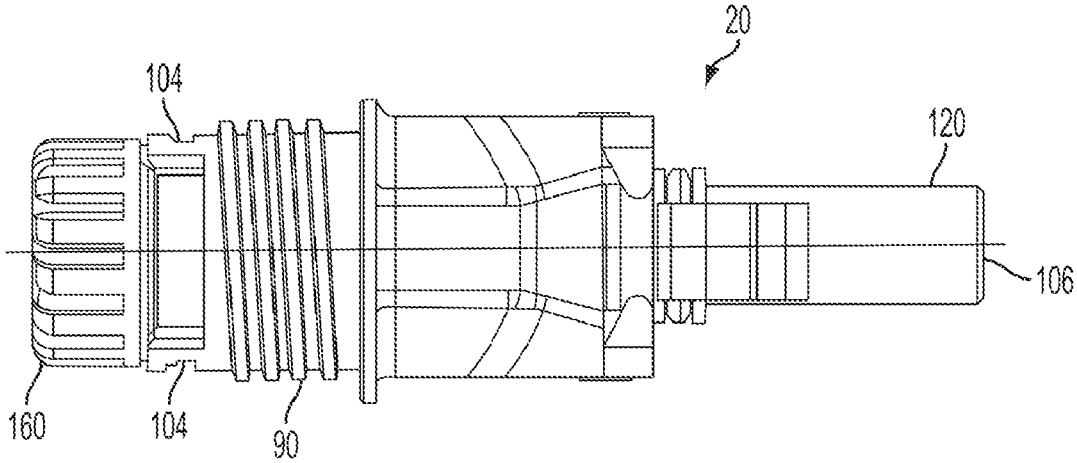
FIG. 6 shows a side view of a second assembly of the electrical connector according to the preferred exemplary embodiment of the present invention.
Figure 7:
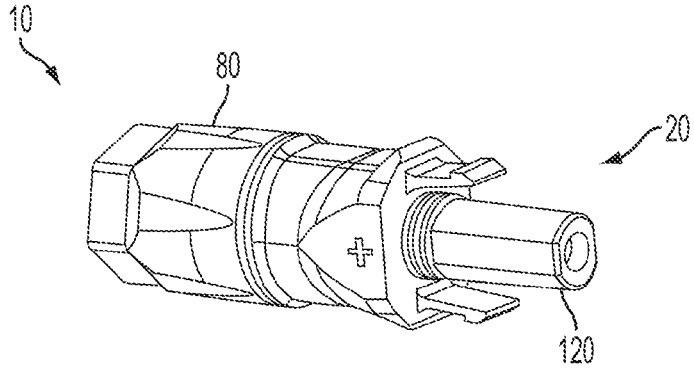
FIG. 7 shows a perspective view of the electrical connector according to the preferred exemplary embodiment of the present invention in the closed state.

In FIG. 6, another lateral top view of the second sub-assembly 20 is illustrated. An elastomeric sealing sleeve (not illustrated) is inserted into a crimp cap 160 at the insertion end of the second sub-assembly. When screwing on, the crimp cap 160 is compressed and seals with the elastomeric sealing ring against the casing (not illustrated) of the conductor. Finally, in FIG. 7, the electrical connector 5 is illustrated in the closed state.

Figure 8:
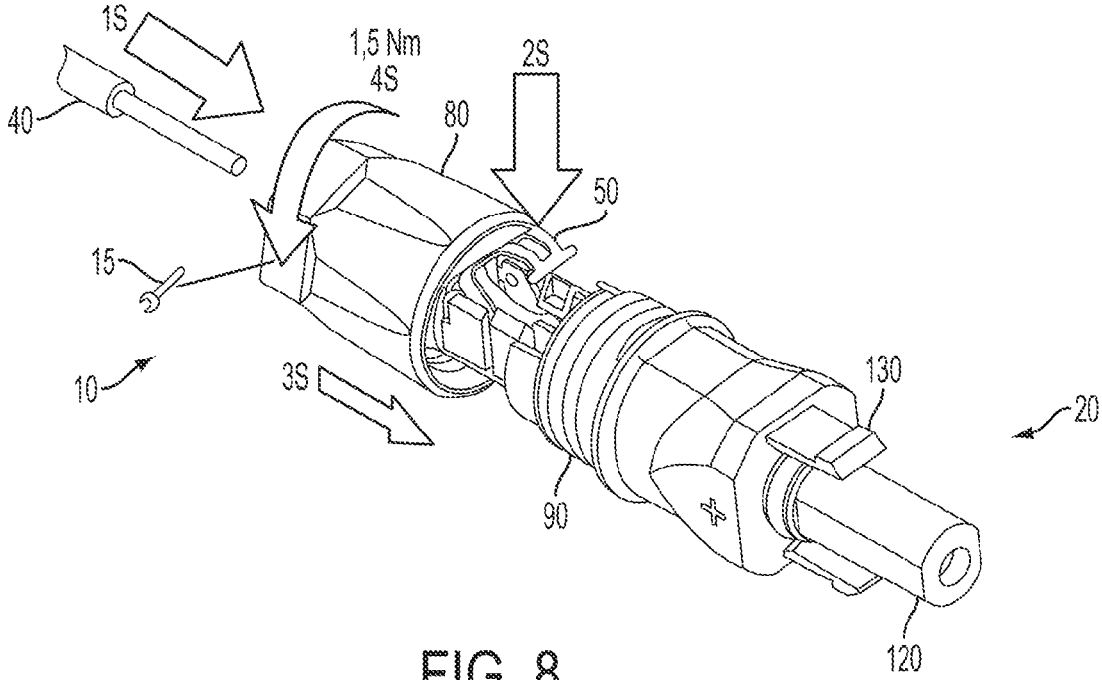
FIG. 8 shows a perspective view of the electrical connector according to the preferred exemplary embodiment of the present invention in the open state for designating the steps for closing the electrical connector.

FIG. 8 shows again the electrical connector in the open state. The arrows designated with the reference numbers 1S, 2S, 3S and 4S indicate in which way the electrical connector is connected to a conductor end 40. In the first step, the conductor end 40 is guided through the opening 150 (not illustrated) through the first sub-assembly up to the contact area. As soon as the conductor end reaches the contact area, the clamping limb 52 of the clamping spring 50 is pivoted about the elbow section. In this state, the clamping spring is slightly pre-tensioned so that the conductor end 40 is not yet finally locked. To achieve a friction-locked mounting of the conductor end 40 with the contact section, subsequently, the actuating section 54 of the clamping spring 50 is pushed down until it snaps in; see reference number 2S. Now, an electrical contact between conductor end and contact area is established. After that, the two sub-assemblies 10 and 20 are inserted into one another until the cap nut 80 abuts against the external thread 90 of the second sub-assembly. In the last step, the thread 90 is now screwed into the nut until the contact area 30 is enclosed in a watertight manner and electrically insulated from the outside. Preferably, inside of the first sub-assembly 10, at least one further locking projection 106 is provided so that in the closed state, the locking nut 104 engages also with the above mentioned locking projection. Thus, in addition to the screw coupling, an interlock of the two sub-assemblies 10 and 20 is provided.

Figure 9:
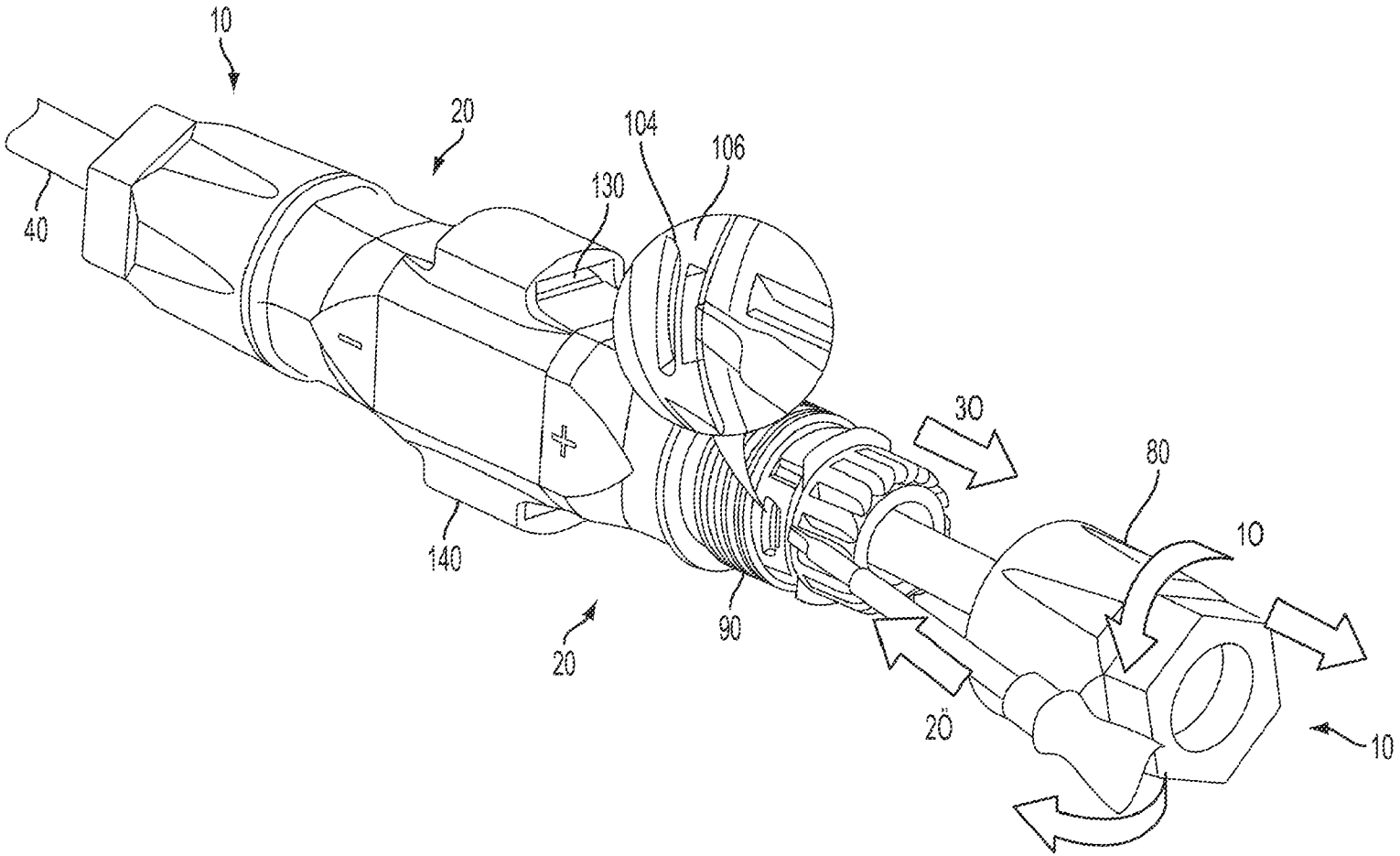
FIG. 9 shows a perspective illustration of the electrical connector according to the preferred exemplary embodiment of the present invention with instructions how to open the connector.

FIG. 9 shows a perspective illustration of two electrical connectors 5 and 6 which are connected to one another. A release element 140 is provided for detachably connecting the connectors. Preferably, the release element 140 is an integral part of one of the connectors, here the connector 6, so that the connector 5 abuts against the release element's 140 edge 7 shown in FIG. 9. At the same time, FIG. 9 illustrates how a closed electrical connector can be opened in order to remove or reinsert a cable end. For this purpose, first, the cap nut must be unscrewed. Reference number 1Ö shows, in which direction the cap nut has to be rotated to be released from the external thread 90. After that, the locking projection 106 inside the first sub-assembly 10 is to be released from the locking groove 104. For this, preferably, a wedge or screw driver end is pushed in the area of the locking groove 104 between the first and second components 10 and 20. In this manner, the locking groove is lifted from the locking projection 106 until the locking projection 106 is no longer engaged with the locking groove 104. Subsequently, the two sub-assemblies 10 and 20 are moved relative to one another in longitudinal direction; see reference number 3Ö.

Figure 10:
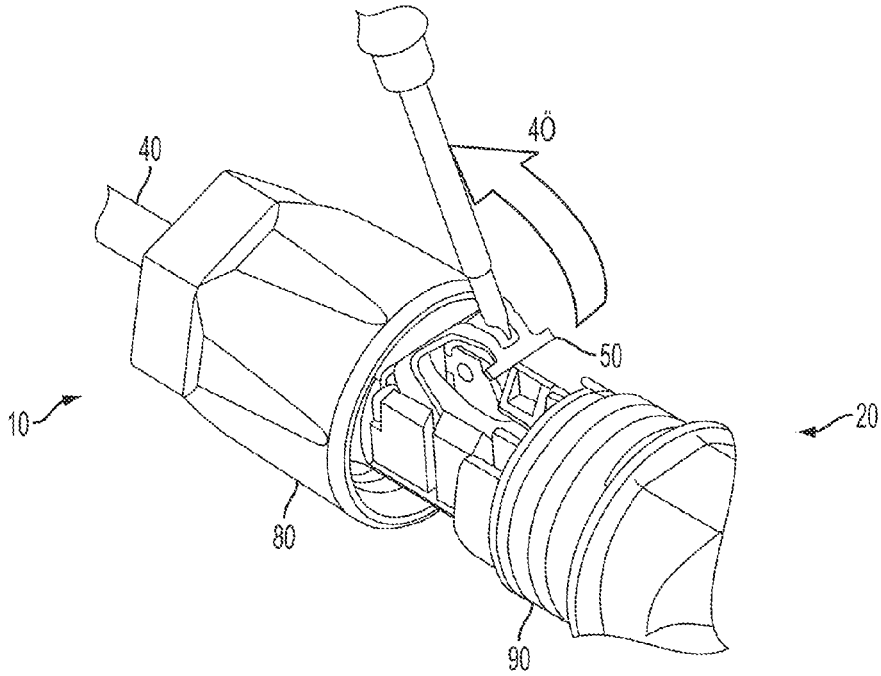
FIG. 10 shows a perspective illustration of the electrical connector according to the preferred exemplary embodiment of the present invention with instructions on how to release a clamping device of the connector.

FIG. 10 shows the electrical connector in the open state after the steps 1Ö, 2Ö and 3Ö were carried out. Reference number 4Ö shows here how the electrical contact between conductor end 40 and contact area 30 is to be disconnected. For this, the actuating section 54 of the clamping spring is lifted in the direction of the arrow 4Ö. After that, the conductor end 40 can be pulled out of electrical connector.

Figure 11:
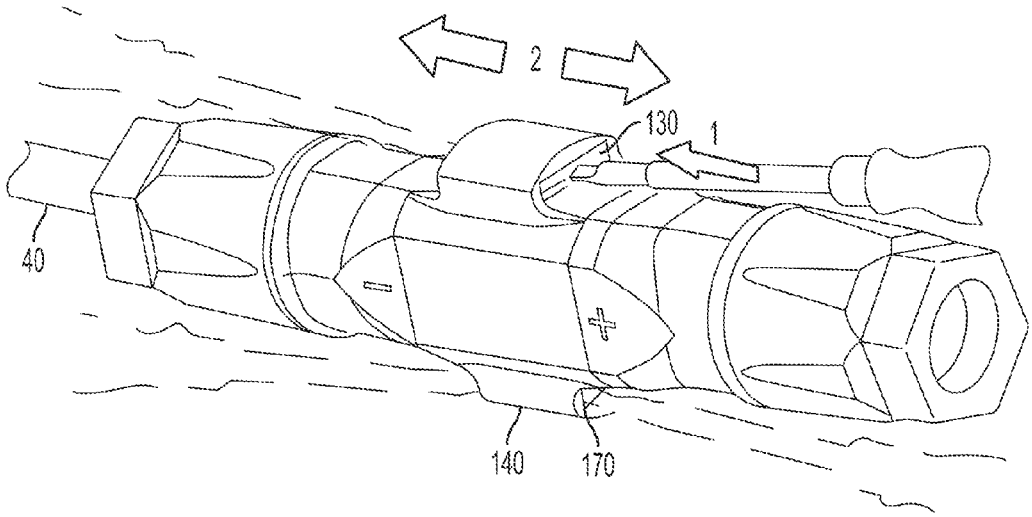
FIG. 11 shows a perspective illustration of two connectors plugged into one another with instructions for separating the connectors.

Finally, FIG. 11 shows two electrical connectors 5, 6 according to the invention which are connected to one another. The mechanical fastening of the housings of the electrical connectors 5 and 6 takes place by means of the contact springs 130, the projections of which engage with and snap into recesses 141 which are covered by the release element 140.

By covering the recesses, the release element serves, amongst other things, for avoiding an unintended actuation of the contact springs and thus an unintended disconnection of the plug connection. For this purpose, the release element 140 has two covers 142 which are opposing each other and which cover the recesses 141. To disconnect the electrical connectors, the contact springs 130 are pushed out of the connecting groove, for example by means of a screw driver. After that, the electrical connectors 5, 6 are pulled apart from one another in the direction of the arrows. The release element is movable transverse to the direction of the arrow 2 and is fastened on the connector 6. Furthermore, within the release element, actuating elements are provided which can be moved radially inward in a flexible manner and which act on the ends of the contact springs 130. By inserting the screw driver, the actuating element is moved radially inwardly and drives the contact spring so that the same is moved radially inwardly out of the recess. By the insertion of the screw driver into the opening between the cover and the recess, the release element 140 is moved at the same time in the opposite direction, thereby acting on the opposing actuating element which thus is also moved radially inwardly so that also the other contact spring is bent radially inwardly and the locking projection of the same moves out of the recess 141. The two connectors 5, 6 can pulled apart from one another and thus can be separated.

It is obvious for the person skilled in the art that the above described embodiment is to be understood as an example and the invention is not limited thereto, but can be varied in numerous ways without departing from the invention. It is further obvious for the person skilled in the art that the features are independent of whether they are disclosed in the description, claims, figures or otherwise, and also define individually essential parts of the invention and can be taken individually for limiting the scope of protection even if they are described together with other features.

REFERENCE LIST

1Ö Screwing on the cap nut
2Ö Releasing the locking device
3Ö Pulling apart the sub-assemblies
4Ö Releasing the clamping device

1S Inserting the conductor end
2S Clamping the conductor end
3S Moving the sub-assemblies into one another
4S Screwing the cap nut of the first sub-assembly together with the external thread of the second sub-assembly
5, 6 Connector
7 Edge of 140
10 First sub-assembly
20 Second sub-assemblies
30 Contact area
40 Conductor end
50 Clamping device
52 Clamping limb
54 Actuating limb
56 Elbow section
60 Hollow body
70 Hollow space
80 Cap nut
90 External thread
100 Locking device
102 Locking projection
104 Locking groove
106 Further locking projection
106 Longitudinal axis
110 First guiding member
120 Second guiding member
130 Contact spring
140 Release element
141 Recess
142 Cover of 140
150 Opening for receiving the conductor end
160 Crimp cap

What is claimed is:

1. An electrical connector comprising:

a) a first sub-assembly comprising a contact area for receiving a conductor end and for establishing an electrical contact with the received conductor end, and a clamping device for clamping the conductor end in the contact area, wherein the clamping device is adapted to clamp the conductor end to the contact area for establishing the electrical contact; and b) a second sub-assembly comprising a hollow body with a hollow space for receiving the contact area;

wherein the first and the second sub-assembly are configured to release the clamping device in the open state, and to electrically insulate the contact area including the clamping device when joined together in the closed state; and wherein, in the open state, the clamping device is operable manually in order to clamp the conductor end.

2. The electrical connector according to claim 1, wherein the contact area including the clamping device is configured to be movable into the hollow space of the hollow body.

3. The electrical connector according to claim 1, wherein the hollow body is configured to enclose the contact area including the clamping device in the closed state in a watertight manner.

4. The electrical connector according to claim 1, wherein the first sub-assembly has a cap nut for closing the contact area with the received conductor end; and the hollow body has an external thread to be screwed together with the cap nut, wherein the hollow body screwed together with the cap nut electrically insulates the contact area.

5. The electrical connector according to claim 1, with a locking device for detachably locking the first and second sub-assembly in the open and/or closed state.

6. The electrical connector according to claim 1, with a linear guide for guiding the first and second sub-assembly relative to one another along a linear path.

7. The electrical connector according to claim 6, wherein the linear guide is formed by two guiding members which are telescopically movable into one another, wherein the first sub-assembly includes the first guiding member, and the second sub-assembly includes the second guiding member.

8. An electrical connector comprising:

a) a first sub-assembly comprising a contact area for receiving a conductor end and for establishing an electrical contact with the received conductor end, and a clamping device for clamping the conductor end in the contact area;

b) a second sub-assembly comprising a hollow body with a hollow space for receiving the contact area; and c) a linear guide for guiding the first and second sub-assembly relative to one another along a linear path;

wherein the first and the second sub-assembly are joined together and are made as one piece and are configured to release the clamping device in the open state for manually clamping the conductor end, and to electrically insulate the contact area including clamping device in the closed state;

wherein the linear guide is formed by two guiding members which are telescopically movable into one another, wherein the first sub-assembly includes the first guiding member, and the second sub-assembly includes the second guiding member; and wherein the first guiding member of the first sub-assembly is electrically connected with the contact area, and the second guiding member of the second sub-assembly, in the closed state, electrically insulates the first guiding member.

9. The electrical connector according to claim 8, wherein the contact area including the clamping device is configured to be movable into the hollow space of the hollow body.

10. The electrical connector according to claim 8, wherein the hollow body is configured to enclose the contact area including the clamping device in the closed state in a watertight manner.

11. The electrical connector according to claim 8, wherein the first sub-assembly has a cap nut for closing the contact area with the received conductor end; and the hollow body has an external thread to be screwed together with the cap nut, wherein the hollow body screwed together with the cap nut electrically insulates the contact area.

12. The electrical connector according to claim 8, with a locking device for detachably locking the first and second sub-assembly in the open and/or closed state.

* * * * *